US005094051A

United States Patent [19]

Miller

[11] Patent Number: 5,094,051

[45] Date of Patent: Mar. 10, 1992

[54] WALL PANEL MOUNTING SYSTEM

[75] Inventor: Frank Miller, Farmingdale, N.Y.

[73] Assignee: The Lamparter Organization, Inc., Farmingdale, N.Y.

[21] Appl. No.: 567,246

[22] Filed: Aug. 14, 1990

[51] Int. Cl.[5] ..... E04B 2/88

[52] U.S. Cl. ..... 52/235

[58] Field of Search ..... 52/235, 460, 399

[56] References Cited

U.S. PATENT DOCUMENTS 3,553,918 1/1971 Dauson ..... 52/235

3,867,799 2/1975 Pryor et al. ..... 52/235

4,307,551 12/1981 Crandell ..... 52/235

*Primary Examiner*—Richard E. Chilcot, Jr.

*Assistant Examiner*—Michele A. Van Patten

*Attorney, Agent, or Firm*—Collard, Roe & Galgano

[57] ABSTRACT

A system for mounting a series of decorative panels onto the outer surface of a building includes four basic elements, a baseplate, a cover plate and two panel edge brackets. The baseplate has a generally centrally-disposed wall portion securable to the outer surface of a building and the cover plate is mountable on the baseplate to cover the centrally-disposed portion. The cover plate has an outer surface which defines a base wall of a caulkless joint. Each of the panel edge brackets has a panel wall securable to an edge of a decorative panel. Male-female locking elements are associated with the base and cover plates for clamping the panel edge brackets to either the baseplate or the cover plate so that the panel walls of the panel edge brackets are generally normally disposed to, and abut, the outer surface of the cover plate. As a result, the panel walls define the joint sidewalls of the caulkless joint.

9 Claims, 3 Drawing Sheets

WALL PANEL MOUNTING SYSTEM

BACKGROUND OF THE INVENTION

The present invention relates to a system for mounting a series of decorative panels onto the outer surface of a building. More particularly, it relates to such a system which is specifically intended for retrofitting the exterior skins of buildings with prefabricated modular interconnected exterior building panels and which provides a caulkless joint between the panels.

Various systems for retrofitting existing buildings with modular wall panels are well known in the art. One such system, referred to as the "Fedderlite TM Panel System" and sold by Tech 21 Panel Systems, Inc. of Arlington, Texas, connects decorative panels to the existing surface of a building wall via extruded aluminum stiffening members (see U.S. Pat. No. 4,641,469), which provide a mechanism to mechanically fasten the panels to the wall. However, this system and many others require the use of caulk or other sealants between the joints of adjacent panels. In addition, the joints must be relatively large to allow the installer to secure the extrusion to the building wall and to apply the sealant to the joint between adjacent panels. However, as a result of the expansion and contraction fluctuations over a period of time, the caulking becomes fatigued, causing rupture, thus destroying the watertight seal. Thus, as can be appreciated, such caulked joints require continued maintenance from time to time since, if they are not properly maintained, they can serve as a source for water penetration behind the panels and eventually into the building.

SUMMARY OF THE INVENTION

Therefore, it is an object of the present invention to provide a system for mounting prefabricated decorative exterior wall panels on the outside of a building, which will have no caulking in the joints and still provide for a dry, watertight seal between the panels.

It is a further object of the present invention to provide such a system for mounting decorative wall panels on the outside of a building that is of simple construction, of universal application, which facilitates easy mounting, and is labor-saving and inexpensive to produce.

These and other objects of the present invention are achieved in a system for mounting a series of decorative panels on the outside surface of a building, which includes a elongated baseplate having a generally centrally-disposed wall portion securable to the outer surface of a building. A elongated cover plate is mountable on the baseplate to cover the centrally-disposed wall portion and it has an outer surface which defines a base wall of a caulkless joint. The system further includes a pair of elongated panel edge brackets, each of which has a panel wall securable to an edge of a decorative panel. Male-female locking means are associated with the brackets and plates for clamping the panel edge brackets to either one of the baseplate and cover plate, respectively, so that the panel walls of the panel edge brackets are generally normally disposed to, and abut, the outer surface of the cover plate, whereby the panel walls generally define the joint sidewalls of the caulkless joint.

Preferably, the locking means comprises a pair of associated and cooperating male and female locking members engageable with one another in a snap-fit frictional manner. The plates and brackets are advantageously made of metal extrusions and, in particular, aluminum. Most desirably, the system additionally includes at least two decorative panels to each of which one of the panel edge brackets is secured.

In a preferred embodiment of the invention, the baseplate comprises two generally planar, lateral end walls joined by a generally centrally-disposed recessed channel section which defines the wall portion attachable to the building wall. One of the end walls of the baseplate has one of the male locking members mounted thereon. Correspondingly, the cover plate is generally planar and has two ends and the "other" of the male locking members is mounted thereon adjacent one of the ends thereof. In a complementary fashion, the panel edge walls of each of the panel edge brackets has one of the female locking members mounted thereon so that one of the panel edge brackets may be clamped to the male member of the baseplate and the other of the panel edge brackets may be clamped to the male member of the cover plate via the respective female members.

In a particularly preferred embodiment of the invention, the male locking members comprise generally U-shaped locking members having a pair of sidewalls with notched outer sides and the female locking members comprise generally U-shaped locking members having a pair of sidewalls with protuberances on their inner sides which are configured and dimensioned to engage the notched outer sides of the male members in a snap-fit frictional manner when the male members are inserted in the respective female members.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
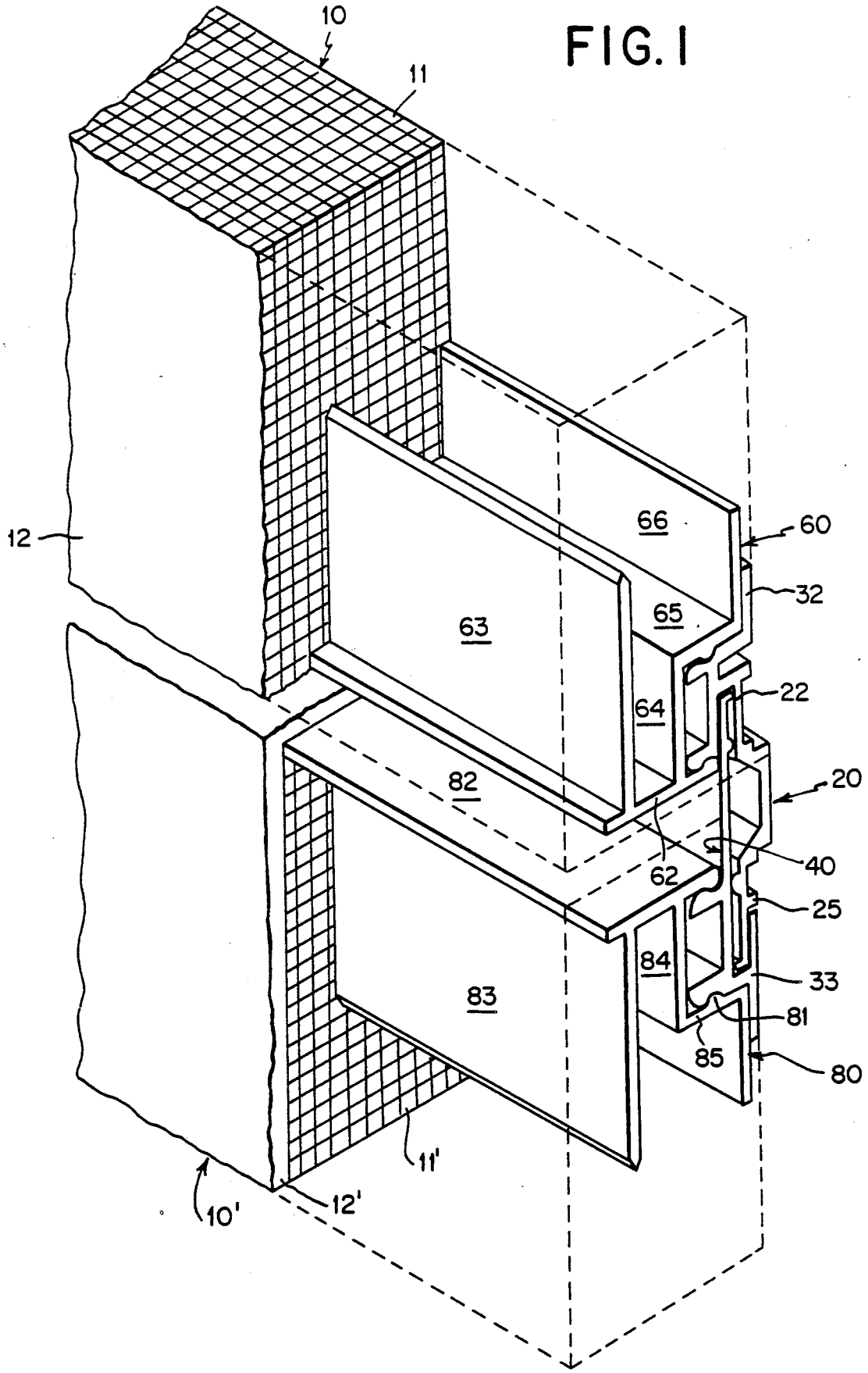
FIG. 1 is a perspective view of the mounting system of the present invention, with portions of the decorative panels shown in phantom line.
Figure 2:
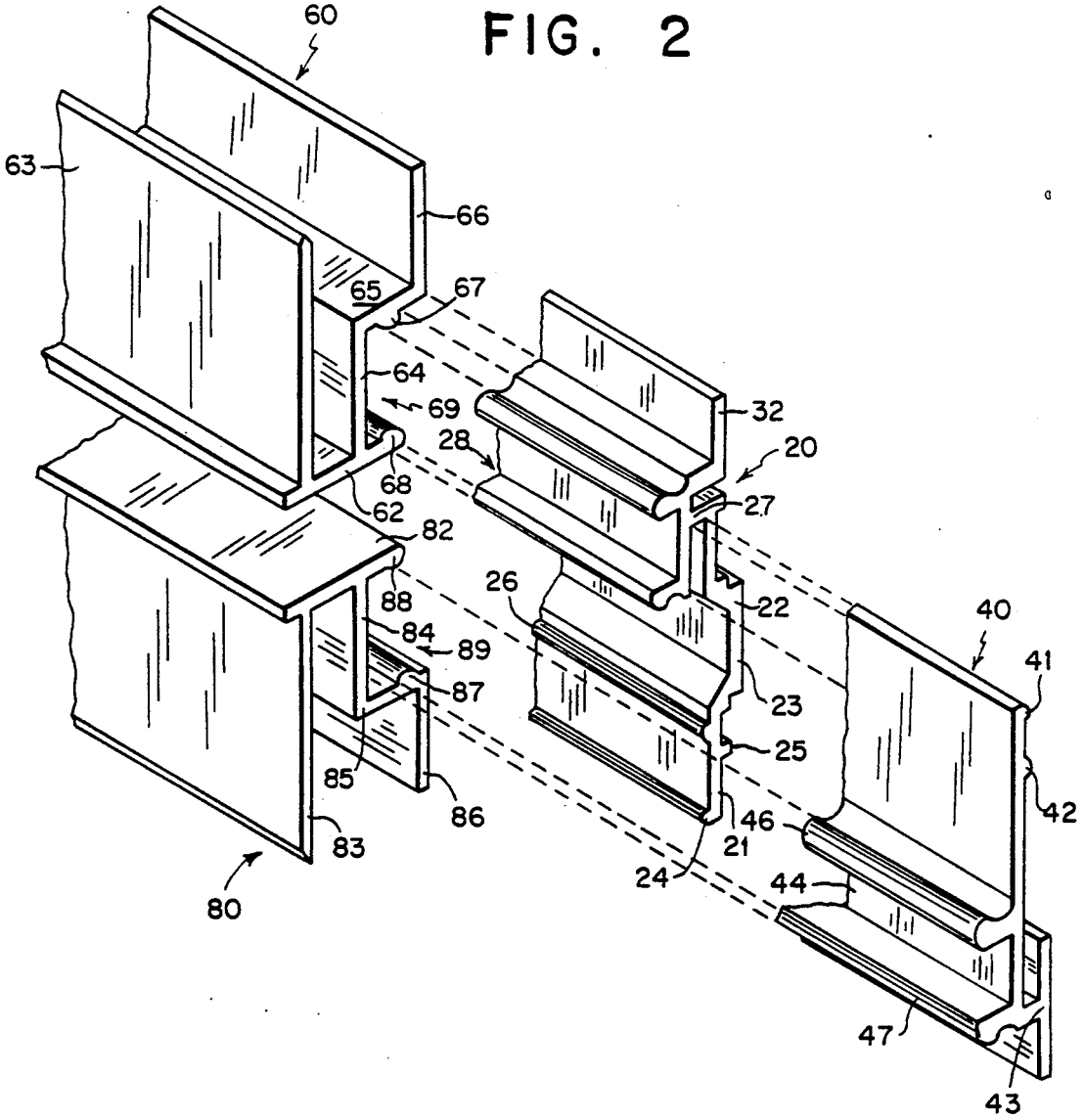
FIG. 2 is an exploded view of the mounting system plates and brackets shown in FIG. 1.

Referring now to the drawings, therein illustrated is a novel mounting system for mounting a series of decorative panels 10, 10' onto the outer surface of a building or other support wall or substrate 13. The decorative panels 10, 10' are made from a wide variety of materials, such as, plastic, metal, wood, glass, stone, foam, or a combination thereof. As can be seen in FIG. 1, the prefabricated panels typically consist of a foam insulation board inner core 11, 11' the front and side faces of which are covered with a surface coating 12, 12' e.g., a plaster or other finish. The mounting system basically includes four elements, namely, a baseplate 20, a cover plate 40 and two panel brackets 60, 80, each of which are typically fabricated from aluminum extrusions.

Figure 3:
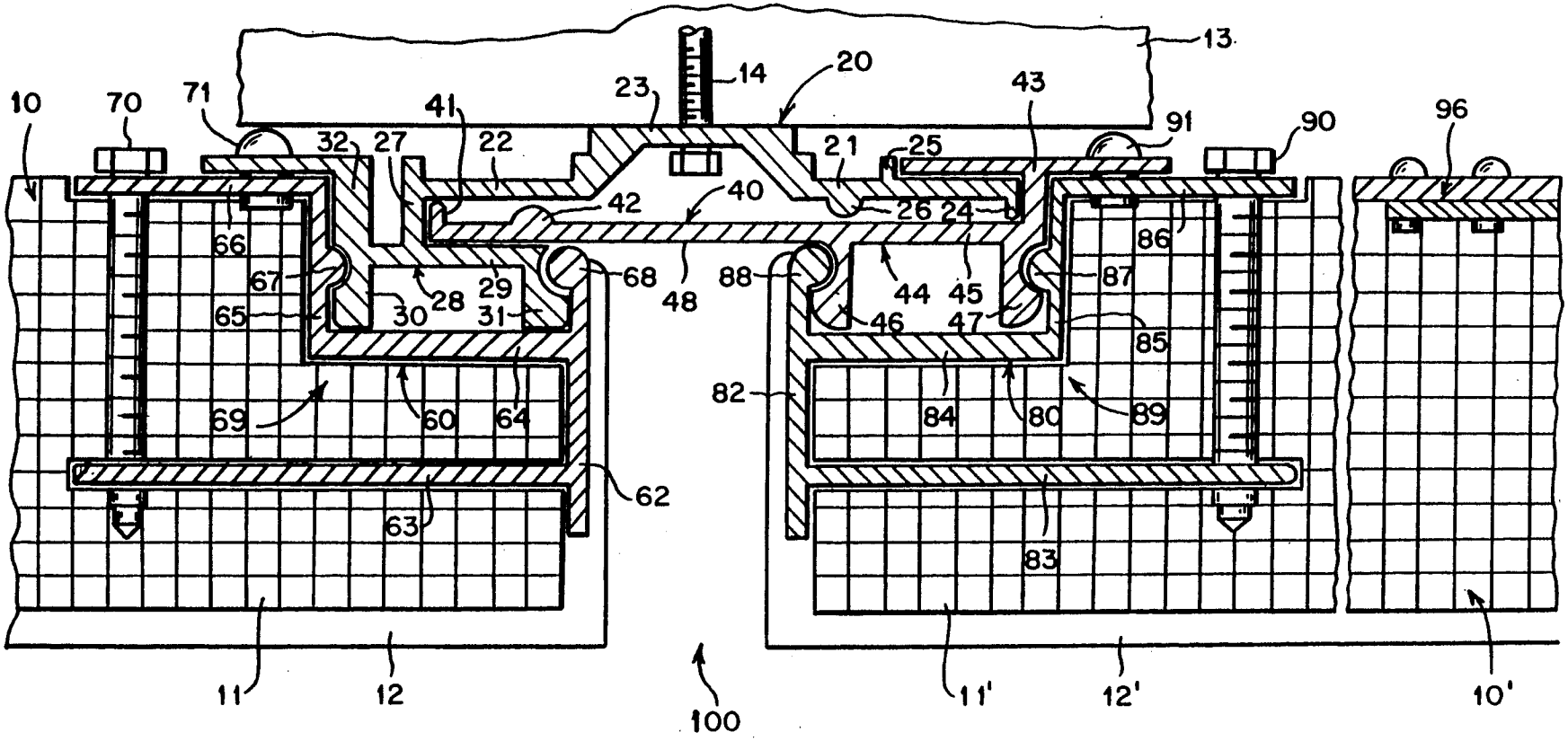
FIG. 3 is a cross-sectional view, showing the mounting system supporting two fragmentarily-illustrated decorative panels to the wall of an existing building.

As seen best in FIG. 3, baseplate 20 has two lateral end walls 21, 22 joined by a recessed central, generally U-shaped panel section 23, the recessed base of which is intended to be screwed or otherwise fastened via screw 14 to the existing building wall 13. Lateral end wall 21 has an outwardly extending flange 24 at its end and an inwardly extending abutment flange 25, spaced generally centrally thereof and an outwardly extending semi-circular spacer or abutment 26 inwardly spaced therefrom, the purpose of which will be described in greater detail hereinafter. Lateral end wall 22 has an outwardly extending flange 27 at its end which supports a generally U-shaped male clamping member, generally designated 28, having a base wall 29 and two notched sidewalls 30, 31. Sidewall 30 has a depending L-shaped flange 32, the purpose of which will also be described in greater detail hereinafter.

Cover plate 40 is intended to slide and fit over baseplate 20. Cover plate 40 has a first end with an inwardly directed flange 41 and an inwardly directed semi-circular spacer or abutment 42 inwardly spaced therefrom, which are dimensioned to allow cover plate 40 to be slidably inserted and rest between the base wall 29 of the male clamping member 28 and the lateral end wall 22 of baseplate 20, with flange 41 abutting flange 27; the spacers 26, 42 facilitating the sliding action and effecting appropriate spacing of the parts. The opposite end of cover plate 40 has an inwardly directed T-shaped flange 43 which is configured and dimensioned to allow sliding receipt of the cover plate 40 over the end 21 of baseplate 20 with flange 24 abutting the base of T-shaped 43 and abutment flange 25 abutting one arm of T-shaped flange 43. The opposite end of cover plate 40 also defines an outwardly extending, generally U-shaped male clamping member 44 having a base wall 45 and notched sidewalls 46, 47, the purpose of which will be described in greater detail hereinafter.

The decorative panels 10, 10' are each secured to an edge brackets 60, 80. The mirror-image and adjacent edge bracket 60, 80, each includes a wall panel 62, 82 which is generally parallel to the edge of the decorative panels 10, 10' and, as shown, can be covered by the surface coating 12, 12' of the decorative panel. Each edge bracket 60, 80 has a first flange 63, 83 disposed normally to wall panel 62, 82 which is embedded in the foam core 11, 11' of the respective decorative panel 10, 10'. The edge brackets 60, 80 also have a stepped generally Z-shaped second flange consisting of a first leg 64, 84 perpendicular to the wall panel 62, 82, a second leg 65, 85 parallel to wall panel 62, 82 and a third leg 66, 86 perpendicular to the second leg 65, 85, the latter of which rests adjacent the respective inner side of panels 10, 10'. The inner end of wall panels 62, 82 and the second legs 65, 85 have opposing rounded protuberances 67, 68, 87, 88 which together with wall panels 62, 82, and first and second legs 64, 65, 84, 85 define a generally U-shaped female clamping member 69, 89. These female clamping members 69, 89 are dimensioned and configured to mate in a snap-fit manner with either the male portion 44, 28 of the cover plate 40 or the baseplate 20, respectively. A bolt 70, 90, extends through the third leg 66, 86 of the second flange and the first flange 63, 83 to secure the decorative panels 10, 10' to the brackets 60, 80. In addition, a pop rivet 71, 91 is used to secure the third leg 66, 86 of the Z-shaped flange of the panel edge brackets 60, 80 to the T-shaped flange 43 of cover plate 40 and the L-shaped flange 32 of baseplate 20, respectively.

The various elements of the mounting system, including the decorative panels, are intended to be manufactured at a manufacturing site, remote from the jobsite where the building is located. The edge brackets 60, 80 would be inserted onto the panels 10 and secured thereto via bolts 70, 90, so that the surface covering 12, 12' would also cover the wall panels 62, 82. The panels may be provided with a reinforcing strap assembly 96 to add strength and rigidity to the panels. The panels and attached brackets would then be transported to the jobsite for attachment to the building. Initially, the baseplate 20 would be attached via its male clamping member 28 to one of the decorative panels 10 via the female clamping member 69 of its associated edge bracket 60. Preferably, the baseplate 20 and the bracket 60 would then be joined by pop rivet 71 so to provide a sturdy connection therebetween. Then, the baseplate—would be secured via screws 14 to the wall 13 of the building.

In a separate operation, the other decorative panel 10' would be attached to the cover plate 40 via the cooperating male and female portions 44, 89 of the cover plate 40 and the edge bracket 80, respectively. Preferably, the two brackets would then also be joined by pop rivet 91 to form a rigid subassembly. The cover plate 40 would then be slid into position over the baseplate 20, whereby its outer flanged end 41 would abut the upstanding flange 27 of the baseplate 20 and the opposite flange 24 of the baseplate 20 would abut the upstanding flange 43 of the cover plate 40, respectively. At the same time, the cover plate 40 would cover the central channel of the baseplate 20 and the screw connection 14. The central top surface 48 of cover plate 40 cooperates with the side panels covered 62, 82 of brackets 60, 80 to form a caulkless joint 100 therebetween. The other side edges of the panels can be joined in a similar fashion and suitable copings can be employed to surround the perimeter of a multiplicity of such interconnected panels, as desired or necessary depending on the particular application.

Various modifications may, of course, be made to the system as will be apparent to those skilled in the art. For example, the construction and configuration of the panel edge brackets may be modified to accommodate the type and size of the panel to be installed. Similarly, the construction and configuration of the other system elements may also be modified to suit the particular application intended without compromising the structural relationships hereinbefore described.

Thus, while only one embodiment of the present invention has been shown and described, it is obvious that many changes and modifications may be made thereunto without departing from the spirit and scope of the invention.

What is claimed is:

1. A caulkless joint system for mounting a series of decorative panels onto the outer surface of a building, comprising:

an elongated baseplate having a generally centrally-disposed recessed channel section and two generally planar lateral end walls joined by said generally centrally-disposed recessed channel section which is securable to the outer surface of a building, one of said end walls having a first U-shaped trough;

an elongated cover plate mountable on said baseplate to cover said recessed channel section and which has an outer surface which defines a base wall of a caulkless joint, said cover plate including two ends, one of said end having a second U-shaped trough, the other end being dimensioned and configured to be slidably inserted into the first U-shaped trough of said baseplate, said end wall of said baseplate opposite said first U-shaped trough being dimensioned and configured to be slidably inserted into said second U-shaped trough of said cover plate, said U-shaped troughs, said ends and said end walls creating an interlocked connection between said baseplate and said cover plate;

a pair of elongated panel edge brackets, each of which has a panel edge wall securable to an edge of a decorative panel; and male-female locking means associated with said baseplate and said cover plate for clamping said panel edge brackets to one of said baseplate and said cover plate so that said panel edge walls of said panel edge brackets are generally normally disposed to, and abut, said outer surface of said cover plate, thereby defining the joint sidewalls of said caulkless joint.

2. The system of claim 1, wherein said locking means comprises a pair of associated and cooperating male and female locking members engageable with one another in a snap-fit frictional manner.

3. The system of claim 2, wherein one of said end walls of said baseplate has one of said male locking members mounted thereon.

4. The system of claim 3, wherein said cover plate is generally planar and has two ends and wherein the other of said male locking members is mounted thereon adjacent one of said ends thereof.

5. The system of claim 4, wherein said panel edge walls of each of said panel edge brackets has one of said female locking members mounted thereon so that one of said panel edge brackets may be clamped to said male member of said baseplate and the other of said panel edge brackets may be clamped to said male member of said baseplate via said female members.

6. The system of claim 2, wherein said male locking members comprise generally U-shaped locking members having a pair of sidewalls with notched outer sides and wherein said female locking members comprise generally U-shaped locking members having a pair of sidewalls with protuberances on their inner sides which are configured and dimensioned to engage said notched outer sides of said male members in a snap-fit frictional manner when said male members are inserted in said female members.

7. The system of claim 1, additionally including at least two decorative panels to each of which one of said panel edge brackets is secured.

8. The system of claim 1, wherein said plates and brackets are metal extrusions.

9. The system of claim 8, wherein said metal extrusion is aluminum.

* * * * *